US007674135B2

(12) United States Patent
Zeng

(10) Patent No.: US 7,674,135 B2
(45) Date of Patent: Mar. 9, 2010

(54) BOARD-TO-BOARD ELECTRICAL CONNECTOR

(75) Inventor: Qingyong Zeng, Jiangsu (CN)

(73) Assignee: Jiangsu Famfull Electronics Co., Ltd. (CN)

( * ) Notice: Subject to any disclaimer, the term of this patent is extended or adjusted under 35 U.S.C. 154(b) by 0 days.

(21) Appl. No.: 12/137,314

(22) Filed: Jun. 11, 2008

(65) Prior Publication Data

US 2009/0023322 A1 Jan. 22, 2009

(30) Foreign Application Priority Data

Jun. 11, 2007 (CN) ..... 2007 2 0038350 U

(51) Int. Cl.
*H01R 24/00* (2006.01)

(52) U.S. Cl. ..... 439/660; 439/83

(58) Field of Classification Search ..... 439/74, 439/83, 108, 607, 660
See application file for complete search history.

(56) References Cited

U.S. PATENT DOCUMENTS 7,134,907 B2 * 11/2006 Watanabe et al. ..... 439/495
7,207,842 B1 * 4/2007 Kenjo ..... 439/607
7,413,444 B2 * 8/2008 Wang ..... 439/74
7,425,158 B2 * 9/2008 Ookura ..... 439/660

* cited by examiner

*Primary Examiner*—Khiem Nguyen
(74) *Attorney, Agent, or Firm*—Vidas, Arrett & Steinkraus, P.A.

(57) ABSTRACT

A board-to-board electrical connector comprising a male connector including a first insulating base, a plurality of male terminals, each said male terminal having a male contact and a male stator; a female connector including a second insulating base, a plurality of female terminals, each female terminal having a female lead and a female contact extending from the female lead in an bending direction for engagement with said male contact, and a female stator which engages with said male stator, the male contact is a closed ring in shape with at least a protrusion formed at its outside surface, which is restrained in the receiving cavity formed between the first convex of the female contact and the second convex set abreast to the first convex, and the outside surface of which contacts with the first convex and the second convex respectively, the first convex and the second convex being formed with the arm of the female contact bended forth and then back, the protrusion engaging with the first convex or the second convex in a locking manner. The electrical connector disclosed is small in size and the connection of the male terminal and female terminal is reliable.

20 Claims, 9 Drawing Sheets

BOARD-TO-BOARD ELECTRICAL CONNECTOR

CROSS-REFERENCE TO RELATED APPLICATIONS

This application claims the benefit of Chinese Patent Application No. CN200720038350.2, filed Jun. 11, 2007, the entire disclosure of which is hereby incorporated herein by reference.

FIELD OF THE INVENTION

The present invention relates to an electrical connector, and more particularly to an electrical connector that connects two different wire stocks or a wire stock and a flexible printed circuit (FPC).

BACKGROUND OF THE INVENTION

At present, a majority of the board-to-board (BTB) electrical connector product series have the terminal interval exceeding 0.4 mm and their height above 1.2 mm. Electronic products characterized in their small size necessitate smaller connector. However, due to technical difficulties, smaller sized connector is still unavailable in the market.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

Accordingly, the object of the present invention is to provide an electrical connector catering to miniaturization requirement with a tiny volume and high connection stability.

In order to achieve the object set forth, a board-to-board electrical connector as following technical scheme is provided that, A board-to-board electrical connector comprises a male connector including a first insulating base, a plurality of male terminals integrally molded with the first insulating base, each male terminal having a male contact, and a male stator disposed at each end of the first insulating base; a female connector including a second insulating base, a plurality of female terminals received in the second insulating base, each female terminal having a female lead and a female contact extending from the female lead in an bending direction for engagement with the male contact so that the electrical circuit can be on, and a female stator disposed at each end of the second insulating base, which engages with the male stator. Each male contact is a closed ring in shape with at least a protrusion formed at its outside surface and is restrained in the receiving cavity formed between the first convex portion of said female contact and the second convex portion set abreast to the first convex portion, the outside surface of the two opposite side of male contact contacts with the first convex portion and the second convex portion respectively, the first convex portion and the second convex portion being formed with the arm of the female contact bended forth and then back, said protrusion engages with said first convex portion or with said second convex portion in a locking manner.

The second insulating base is formed with a first rib having a third recess set at its two opposite sidewalls respectively, and the first insulating base is formed with a fourth recess for matching to said first rib, said fourth recess having a second rib set at its two opposite sidewalls respectively for matching to said third recess.

The second insulating base possesses a plurality of terminal slots set along its longitudinal direction for receiving female contacts, and the first convex portion of the female contact is formed with third teeth at the surface of the arm near to the female lead for tight engagement with sidewalls of said terminal slot.

The male stator is U-shaped and is formed with a first indentation at its side wall, the first indentation having first teeth projecting from its side surface for tight engagement with the end of said second insulating base.

The female stator is U-shaped with a second indentation formed at one sidewall and at least a projection formed at the other sidewall for tight engagement with the end of said second insulating base, the second indentation having second teeth projecting from its side surface for tight engagement with the end of the second insulating base.

The first convex portion is formed with a second recess on the arm near to the female lead. Each female terminal further includes a male lead with one end disposed in the locking recess that is formed at the outside surface of said male contact. The male lead is Z-shaped.

The male contact is formed with a recess located below the locking recess.

The protrusion is formed with a leading slope at the side distant from the male lead, said leading slope inclining towards the female contact.

Compared with the prior art, the present invention has advantages as follows:

The closed ring of the male contact is restrained in the receiving cavity formed between two opposite convex portion of the female contact and the protrusion engages with either of the two convex portion in a locking manner so that the connection of the male terminal and the female terminal is reliable. Besides, because of the shape of the male contact and the female contact, the electrical connector can achieve a smaller size.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

Figure 1:
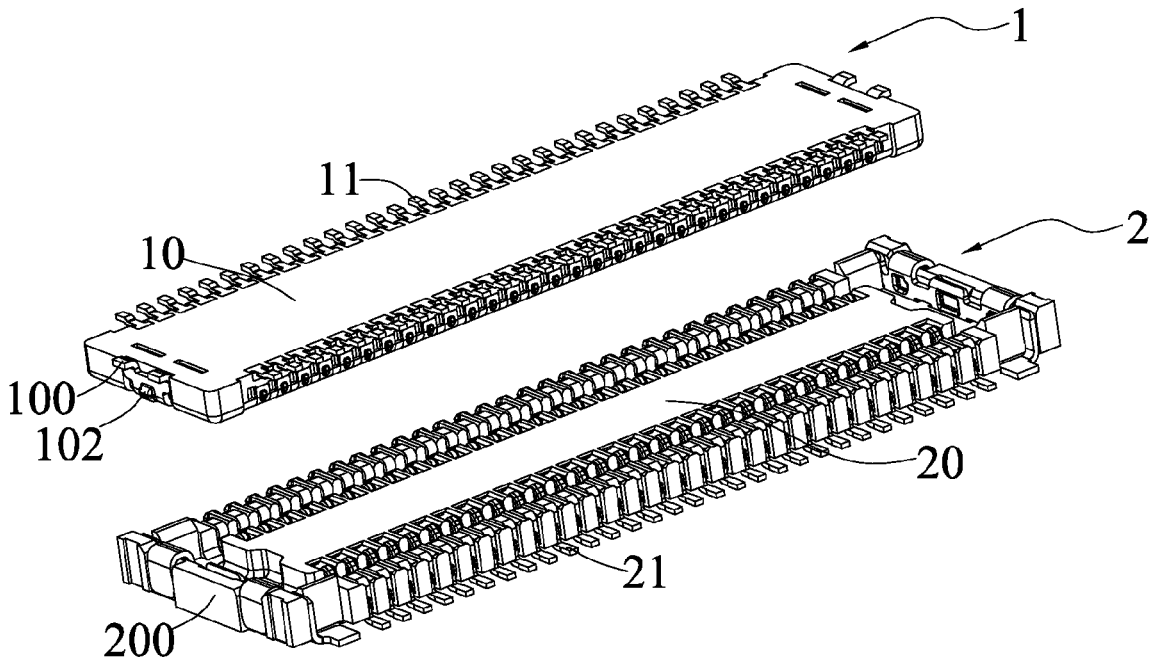
FIG. 1 is a perspective view of a male connector and a female connector in accordance with the present invention.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
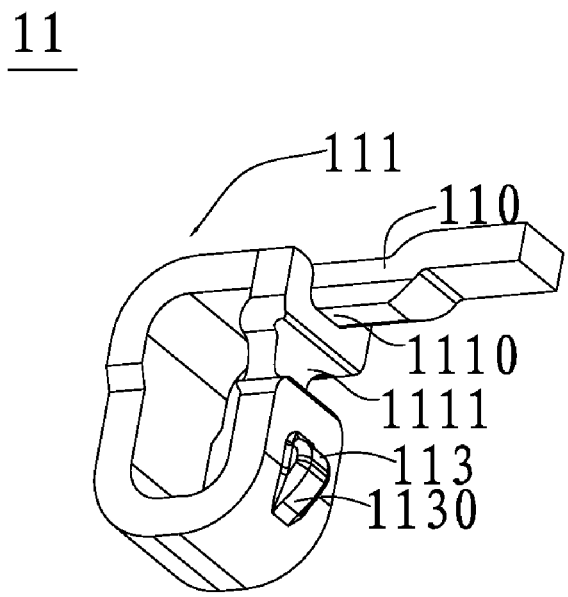
FIG. 2 is a schematic view of a male terminal in accordance with the present invention.
Figure 3:
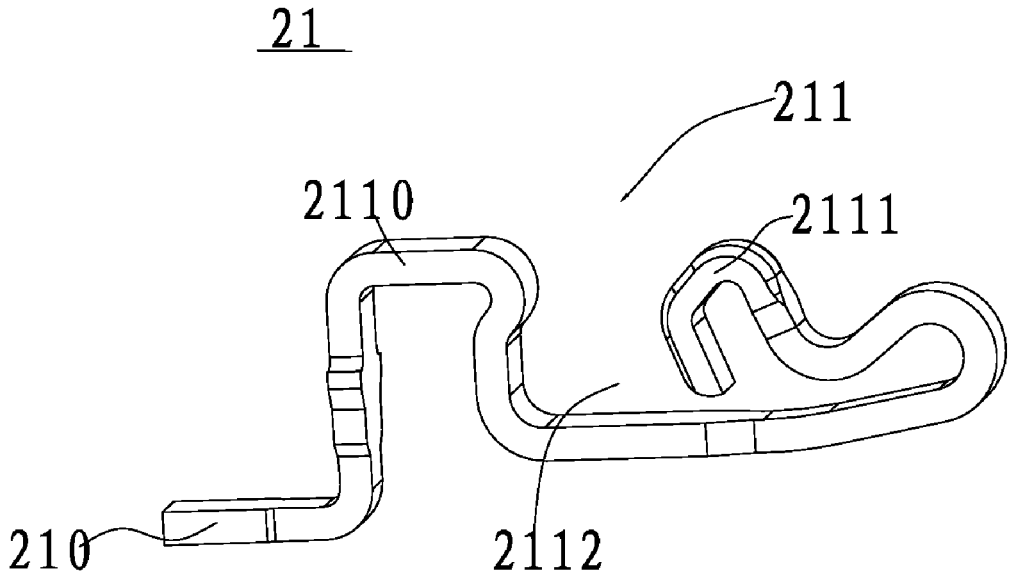
FIG. 3 is a schematic view of a female terminal in accordance with the present invention.
Figure 4:
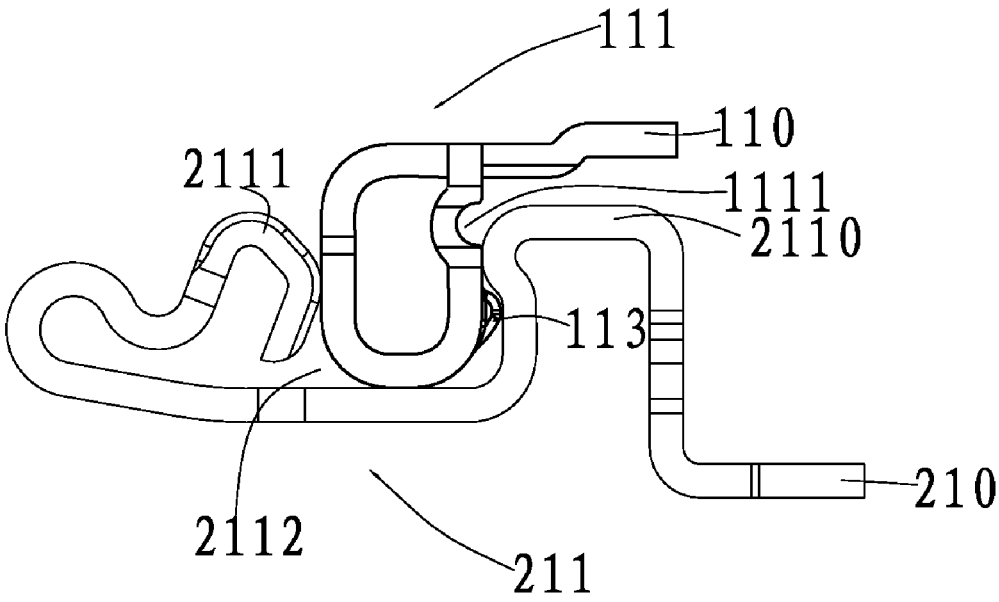
FIG. 4 is a schematic view illustrating engagement of a male terminal with a female terminal.
Figure 5:
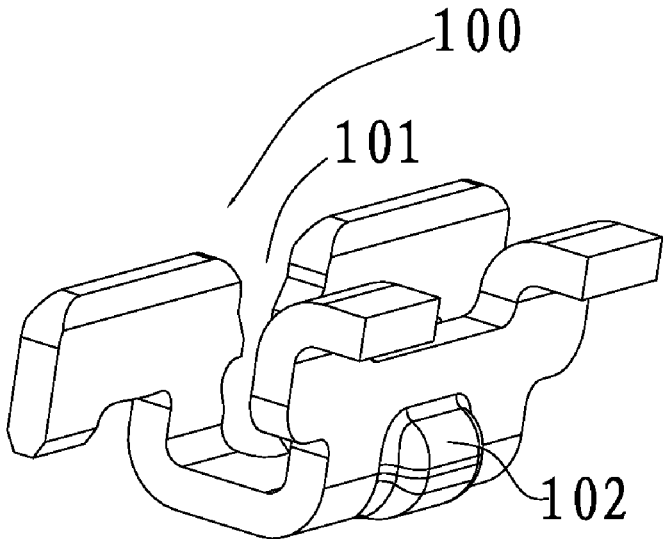
FIG. 5 is a schematic view of a male stator in accordance with the present invention.
Figure 6:
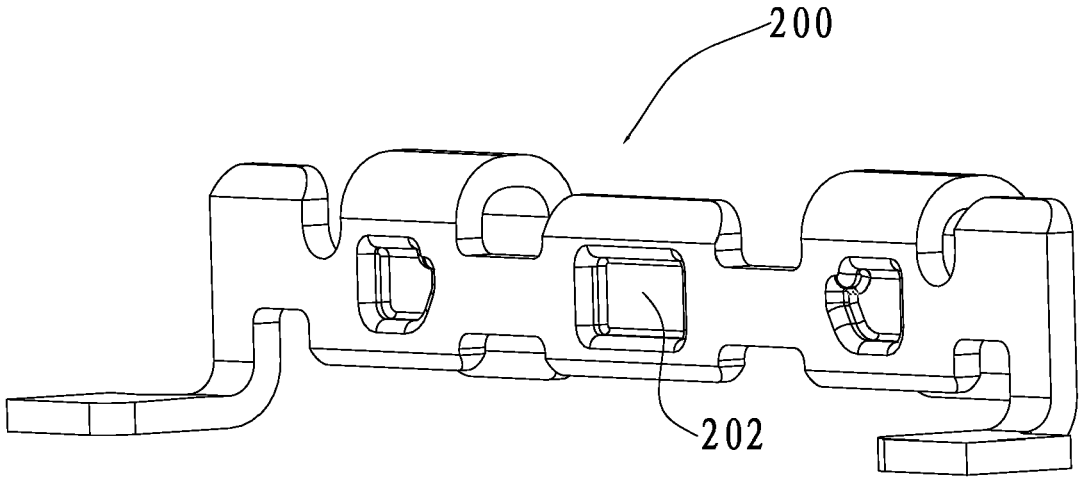
FIG. 6 is a schematic view of a female stator in accordance with the present invention.
Figure 7:
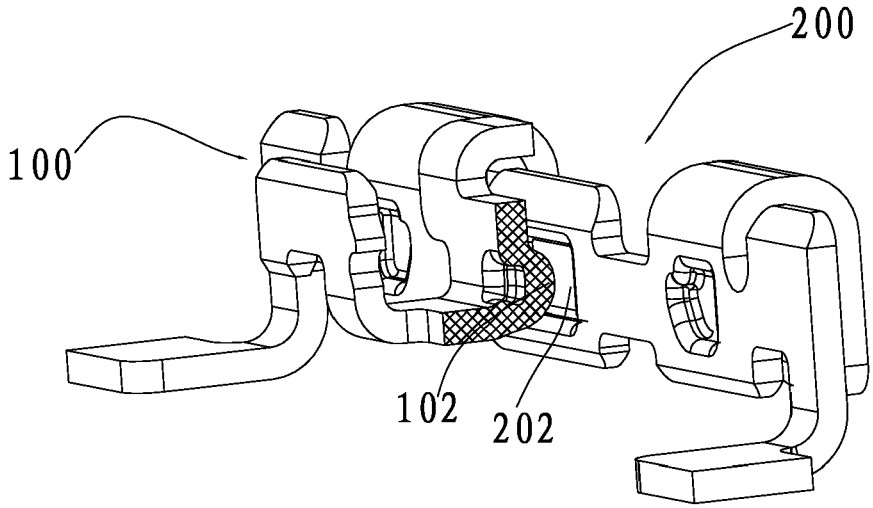
FIG. 7 is a schematic view illustrating engagement of a male stator with a female stator in accordance with the present invention.
Figure 8:
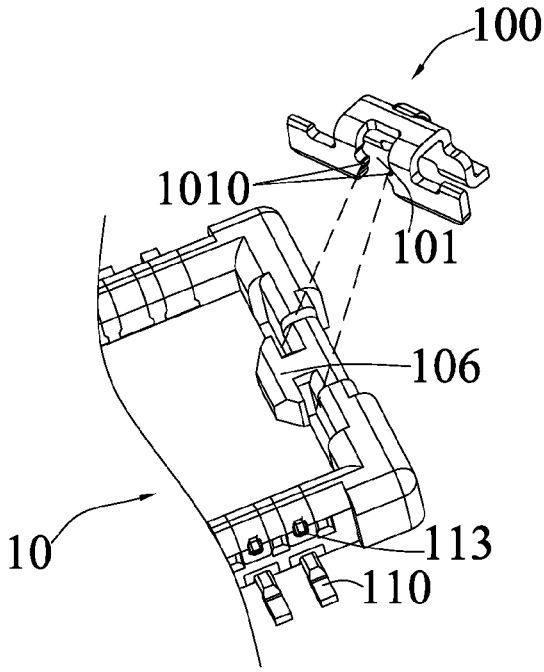
FIG. 8 is a schematic view illustrating engagement of a male stator with the opening end of a first insulating base.
Figure 9:
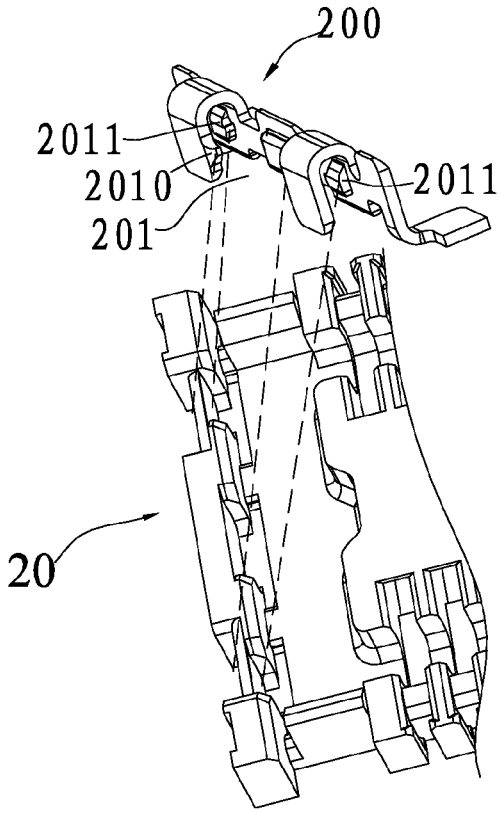
FIG. 9 is a schematic view illustrating engagement of a female stator with the opening end of a second insulating base.
Figure 10:
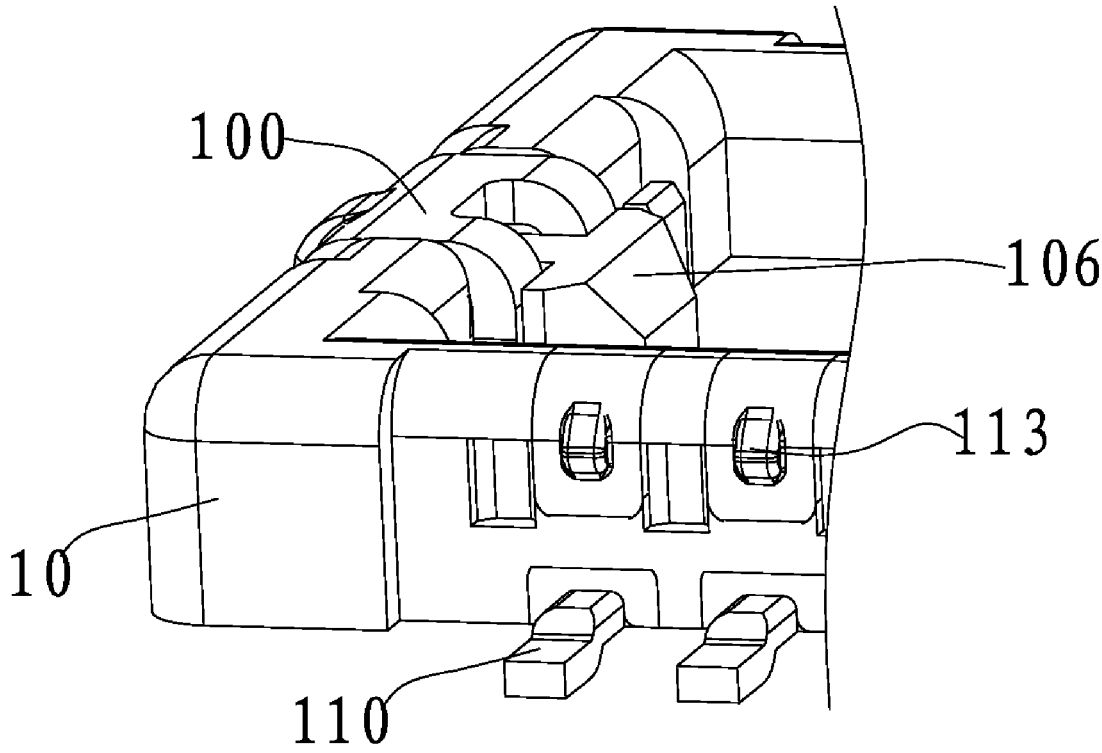
FIG. 10 is a section-enlarged view of a male connector according to the present invention.
Figure 11:
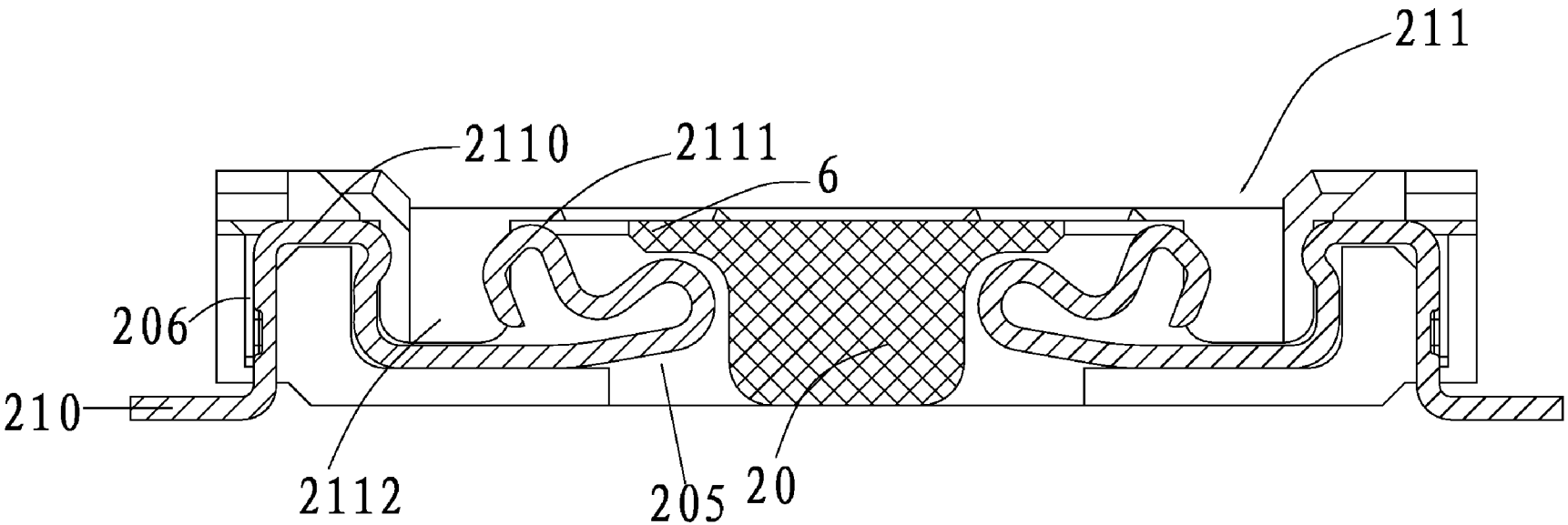
FIG. 11 is a sectional view of a female connector according to the present invention.
Figure 12:
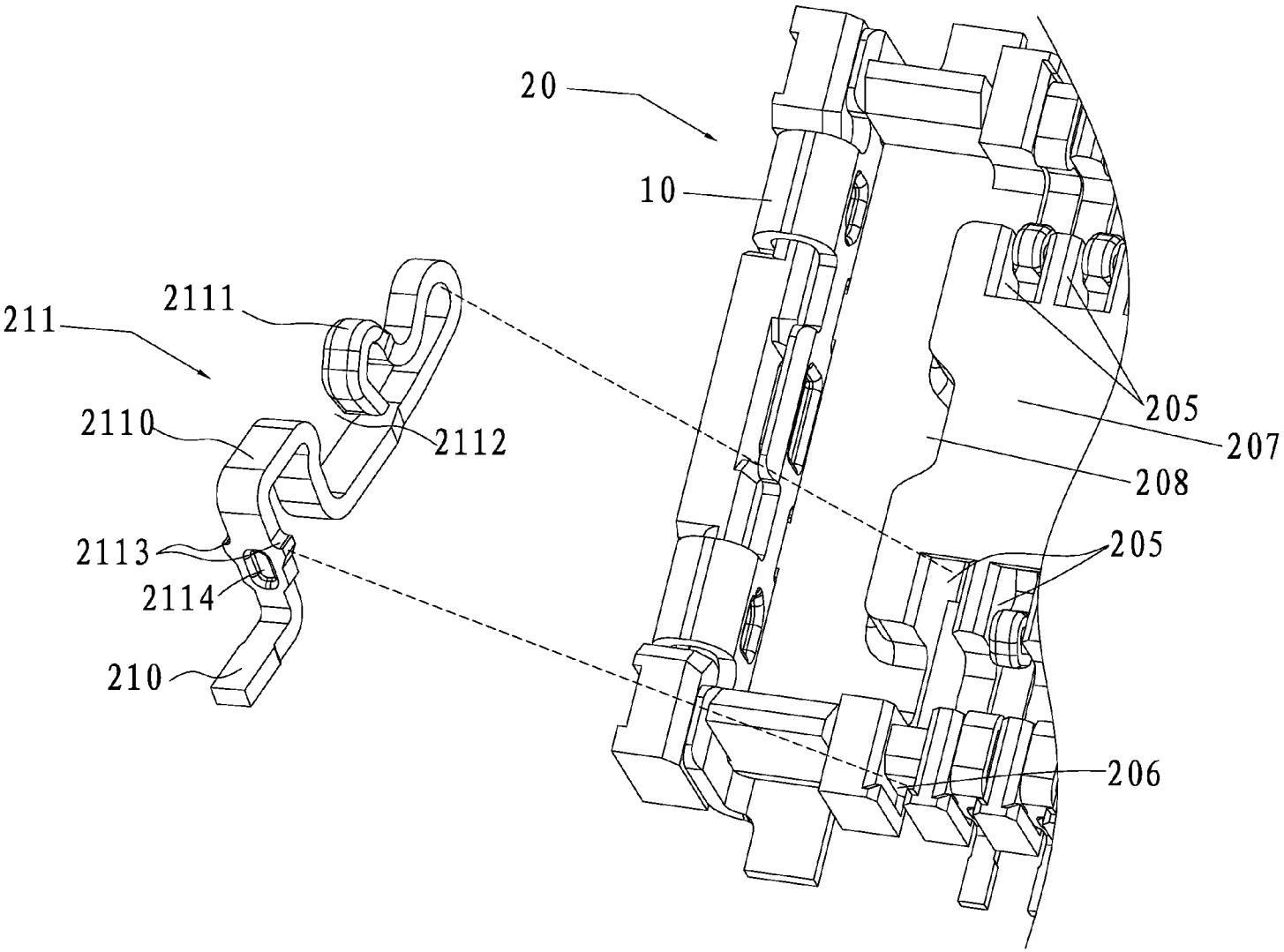
FIG. 12 is a schematic view illustrating engagement of a female terminal with a second insulating base.
Figure 13:
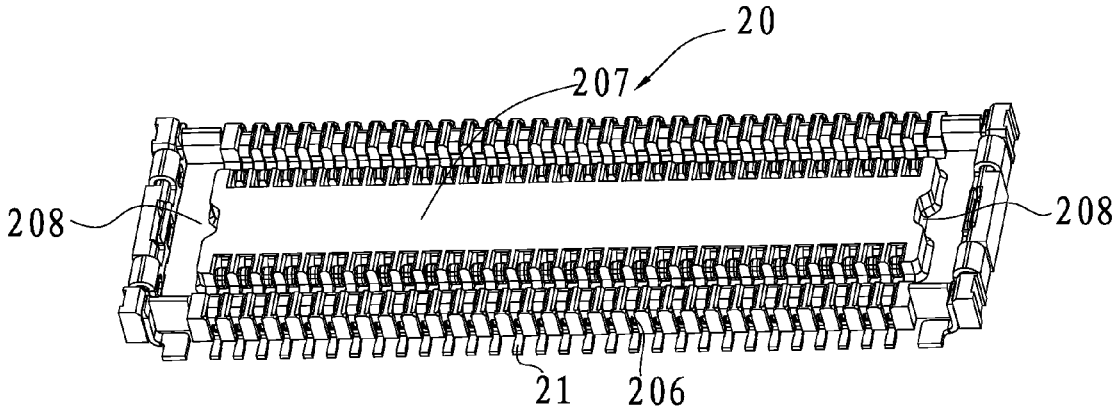
FIG. 13 is a schematic view of a female connector.
Figure 14:
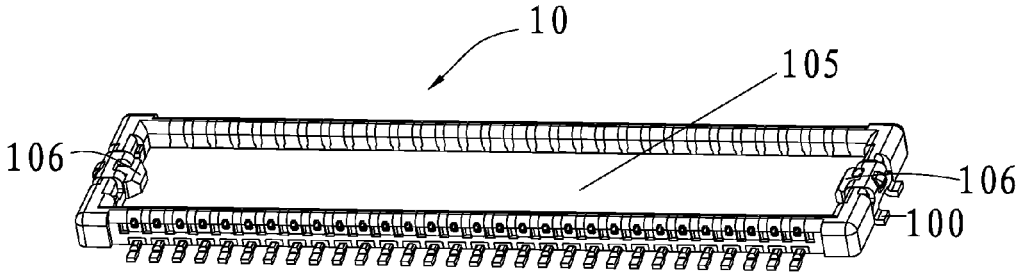
FIG. 14 is a schematic view of a male connector.

Referring to FIG. 1 to FIG. 14, the board-to-board electrical connector in accordance with the present embodiment is composed of a male connector 1 and a female connector 2, both of which are flat-shaped.

The male connector 1 comprises a first insulating base 10, a plurality of arrayed male terminals 11 integrally molded with the first insulating base 10 and a male stator 100 set at each opening end of the first insulating base 10.

The female connector 2 comprises a second insulating base 20, a plurality of arrayed female terminals 21 disposed in the terminal slots 206 of said second insulating base 20 and a female stator 200 set at each opening end of the second insulating base 20.

The end of each male terminal 11 is bended towards a vertical direction and then bended back to form a closed ring defining a male contact 111 having a locking recess 1110 at its joint for reception of a male lead 110. Each male contact 111 is formed with a recess 1111 below said locking recess 1110, which is filled with plastics after being molded so that no ill soldering happens, and a protrusion 113 formed at the outside surface facing female contact 211, which has a leading slope 1130 inclining towards the female contact 211 so that the male connector 1 can be smoothly inserted in the female connector 2. The male lead 110 is Z-shaped ensuring that male terminals 11 can be perfectly tined.

Each said female terminal 21 comprises a female lead 210, a female contact 211 extending from one end of the female lead 210 to contact with the male contact 111. The female contact 211 has an arm being partly bended forth and back to form a first convex portion 2110, and the end of the arm is further bended to form a second convex portion 2111 opposite to the first convex portion 2110. The two convex portions are set abreast to each other and a receiving cavity 2112 is formed between them. The male contact 111 is restrained in the receiving cavity 2112 with its two side surfaces touching the first convex portion 2110 and the second convex portion 2111 respectively, and the male contact 111 simultaneously engages with the protrusion 113 in a locking manner, resulting in that the connection between the male terminal 11 and the female terminal 21 is reliable.

The female contacts 211 should be bended at many parts to bring enhanced elasticity, which is beneficial to dispersing the stress brought about during the inserting process. In addition, the locking interaction of the protrusion 113 and the first convex portion 2110 can plays the role of cleaning. Also, the first convex portion 2110 is formed with a pair of third teeth 2113 at the two side surfaces of the arm respectively near to the female lead 210, which will be discussed later.

The male stator 100 and the female stator 200 are both U-shaped with the former having a first protrusion 102 and the latter being formed with a first recess 202 matching to the first protrusion 102. At the middle part of one sidewall of the male stator 100 there is a first indentation 101 having a pair of symmetrical first teeth 1010 projecting from its two side surfaces. The female stator 200 at the middle part of its side wall also has a second indentation 201 with a pair of symmetrical second teeth 2010. The first teeth 1010 engages tightly with the sidewall of the first insulating base 10 and the second teeth 2010 engages tightly with the sidewall of the second insulating base 20. Besides, the female stator 200 is formed with two projections 2011 at the other sidewall, the projections 2011 engages tightly with the second insulating base 20 enhancing the retention force of the female stator 200 so that it will not be evaded out of the second insulating base 20.

The second insulating base 20 possesses a plurality of terminal slots 206 defining space for receiving the arm of said first convex portion 2110 and the bent arm of the female contact 211 so that the female terminals 21 are positioned with no misalignments.

The first convex portion 2110 has two second recesses 2114 each formed at the middle part of the third tooth 2113. The second recess 2114 is rectangular in shape or other shaped. The recess 2114 can prevent mounting of soldering when the female terminals 21 are tinned.

The bent arm of the female contact 211 is covered by a lid 6, which will prevent the extrusion out of the female terminal 21 when disconnecting the male connector 1 and the female connector 2.

The second insulating base 20 is formed with a first rib 207 having a third recess 208 set at its two opposite sidewalls respectively, and said first insulating base 10 is formed with a fourth recess 105 for matching to said first rib 207, the fourth recess 105 having a second rib 106 set at its two opposite sidewalls respectively for matching to the third recess 208.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A board-to-board electrical connector comprising:

a male connector (1), including a first insulating base (10), a plurality of male terminals (11) integrally molded with said first insulating base(10), each male terminal (11) having a male contact (111), and a male stator(100) disposed at each end of said first insulating base (10); and a female connector (2), including a second insulating base (20), a plurality of female terminals (21) received in said second insulating base (20), each female terminal (21) having a female lead (210) and a female contact (211) extending from said female lead (210) in a bending direction for engagement with said male contact (111), and a female stator (200) disposed at each end of said second insulating base (20), which engages with said male stator (100); characterized in that, each male contact (111) is shaped in a closed ring with at least a protrusion (113) extending from an outside surface of said ring, said protrusion restrained in a receiving cavity (2112) formed between a first convex portion (2110) of said female contact (211) and a second convex portion (2111) set abreast to the first convex portion (2110), said outside surface of said male contact (111) contacting with said first convex portion (2110) and said second convex portion (2111) respectively, wherein the first convex portion (2110) and the second convex portion (2111) each comprise an arm are formed from said female contact (211) by extending forth and then back, said protrusion (113) engaging with said first convex portion (2110) or said second convex portion (2111) in a locking manner.

2. The board-to-board electrical connector according to claim 1, wherein said second insulating base (20) is formed with a first rib (207) having two third recesses (208) set at its two opposite sidewalls respectively, and said first insulating base (10) is formed with a fourth recess (105) for matching to said first rib (207), said fourth recess (105) having two second ribs (106) set at its two opposite sidewalls respectively for matching to the third recesses (208).

3. The board-to-board electrical connector according to claim 1, wherein said second insulating base (20) possesses a plurality of terminal slots (206) set along its longitudinal direction for receiving said female contact (211), and said first convex portion (2110) is formed with two third teeth (2113) symmetrically formed at two side surfaces of its arm near to said female lead (210) for tight engagement with two sidewalls of each terminal slot (206).

4. The board-to-board electrical connector according to claim 1, wherein said male stator (100) is U-shaped and formed with a first indentation (101) at one sidewall, said first indentation (101) having two first teeth (1010) symmetrically projecting from its two side surfaces for tight engagement with an end of the second insulating base (20).

5. The board-to-board electrical connector according to claim 1 or claim 2, wherein said female stator (200) is U-shaped with a second indentation (201) formed at one sidewall and at least a projection (2011) formed at the other sidewall for tight engagement with an end of said second insulating base (20), said second indentation (201) having two second teeth (2010) symmetrically projecting from its two side surfaces for tight engagement with the end of said second insulating base (20).

6. The board-to-board electrical connector according to claim 1, wherein the first convex portion (2111) is formed with a second recess (2114) on its arm near to said female lead (210).

7. The board-to-board electrical connector according to claim 1, wherein each said female terminal (11) further includes a male lead (110) with one end disposed in a locking recess (1110) that is formed at the outside surface of said male contact (111).

8. The board-to-board electrical connector according to claim 7 wherein the male lead (110) is Z-shaped.

9. The board-to-board electrical connector according to claim 7 wherein said male contact (111) is formed with a recess (1111) below said locking recess (1110).

10. The board-to-board electrical connector according to claim 7 wherein the protrusion (113) has a leading slope (1130) at one side distant from said male lead (110).

11. A board-to-board electrical connector comprising:

a male connector including a first insulating base, a plurality of male terminals integrally molded with said first insulating base and a male stator disposed at each end of said first insulating base, each male terminal having a male contact; and a female connector including a second insulating base, a plurality of female terminals received in said second insulating base, each female terminal having a female lead and a female contact extending from said female lead in an bending direction for engagement with said male contact to form a circuit, and a female stator disposed at each end of said second insulating base that engages with said male stator;

wherein each male contact is shaped in a closed ring with a protrusion extending from an outside surface, the closed ring restrained in a receiving cavity formed in said female contact between a first convex portion and a second convex portion set abreast to the first convex portion, the outside surface of said male contact contacting said first convex portion and said second convex portion respectively, wherein the first convex portion and the second convex portion each comprise an arm formed in a loop, said protrusion engaging with said first convex portion or said second convex portion in a locking manner.

12. The board-to-board electrical connector according to claim 11, wherein said second insulating base is formed with a first rib having two recesses formed in its two opposite sidewalls respectively, and said first insulating base is formed with a rib recess for receiving said first rib, said rib recess having two protrusions set at its two opposite sidewalls respectively engaging said recesses.

13. The board-to-board electrical connector according to claim 11, wherein said second insulating base comprises a plurality of terminal slots set along its longitudinal direction for receiving said female contact, and said first convex portion is formed with two teeth symmetrically extending from two side surfaces of its arm near said female lead for engagement with two sidewalls of each terminal slot.

14. The board-to-board electrical connector according to claim 11, wherein said male stator is U-shaped and formed with a first indentation at one sidewall, said first indentation having two teeth symmetrically projecting from its two side surfaces for engagement with an end of the second insulating base.

15. The board-to-board electrical connector according to claim 11, wherein said female stator is U-shaped with an indentation formed at one sidewall and a projection extending from the other sidewall for engagement with an end of said second insulating base, said indentation having two teeth symmetrically projecting from its two side surfaces for engagement with the end of said second insulating base.

16. The board-to-board electrical connector according to claim 11, wherein the first convex portion is formed with a recess on its arm near said female lead.

17. The board-to-board electrical connector according to claim 11, wherein each said female terminal further includes a male lead with one end disposed in a locking recess formed at the outside surface of said male contact.

18. The board-to-board electrical connector according to claim 17, wherein the male lead is Z-shaped.

19. The board-to-board electrical connector according to claim 17, wherein said male contact is formed with a recess below said locking recess.

20. The board-to-board electrical connector according to claim 17, wherein the protrusion has a leading slope at one side distant from said male lead.

* * * * *